US009649749B2

(12) United States Patent
Weiner et al.

(10) Patent No.: US 9,649,749 B2
(45) Date of Patent: May 16, 2017

(54) MANUAL SHARPENER

(71) Applicant: EDGECRAFT CORPORATION, Avondale, PA (US)

(72) Inventors: Samuel Weiner, Wilmington, DE (US); Bela Elek, Wilmington (DE); Daniel D. Friel, Jr., Kennett Square, PA (US)

(73) Assignee: EDGECRAFT CORPORATION, Avondale, PA (US)

( * ) Notice: Subject to any disclaimer, the term of this patent is extended or adjusted under 35 U.S.C. 154(b) by 0 days.

(21) Appl. No.: 14/989,847

(22) Filed: Jan. 7, 2016

(65) Prior Publication Data

US 2016/0207171 A1 Jul. 21, 2016

Related U.S. Application Data

(60) Provisional application No. 62/104,133, filed on Jan. 16, 2015.

(51) Int. Cl.
*B24B 3/54* (2006.01)
*B24D 15/08* (2006.01)

(52) U.S. Cl.
CPC ..... *B24D 15/08* (2013.01)

(58) Field of Classification Search
CPC ..... B21K 5/12; B21K 11/00
USPC ..... 451/65, 555, 461, 45; 76/82, 86, 88
See application file for complete search history.

(56) References Cited

U.S. PATENT DOCUMENTS

| | | | | | |
|---|---|---|---|---|---|
| 1,570,083 | A * | 1/1926 | Runzi | B24D 15/081 | 451/555 |
| 2,137,201 | A | 11/1938 | Boyer | | |
| 2,709,379 | A * | 5/1955 | Murchison | B24D 15/081 | 76/86 |
| 2,749,678 | A * | 6/1956 | Jahn | B24D 15/082 | 451/461 |
| 2,841,926 | A | 7/1958 | Lebus | | |
| 2,860,452 | A | 11/1958 | Lebus | | |
| D284,736 | S | 7/1986 | Kawai et al. | | |
| 4,627,194 | A | 12/1986 | Friel | | |
| 4,716,689 | A | 1/1988 | Friel | | |
| 4,807,399 | A | 2/1989 | Friel | | |
| D303,209 | S | 9/1989 | Friel | | |
| D310,620 | S | 9/1990 | Friel | | |
| 5,005,319 | A | 4/1991 | Friel | | |
| D328,410 | S | 8/1992 | Friel | | |
| 5,148,634 | A | 9/1992 | Bigliano | | |
| 5,245,791 | A | 9/1993 | Bigliano | | |
| 5,390,431 | A | 2/1995 | Friel | | |
| 5,582,535 | A * | 12/1996 | Friel | B24D 15/068 | 451/321 |

(Continued)

OTHER PUBLICATIONS

International Search Report and Written Opinion for International Application No. PCT/US2016/013370 mailed on Mar. 18, 2016.

*Primary Examiner* — Robert Rose
(74) *Attorney, Agent, or Firm* — Drinker Biddle & Reath LLP

(57) ABSTRACT

A manual sharpener includes at least one pre-sharpening stage having interdigitating comb-like abrasive sharpening structure. The sharpener also includes a finishing stage having a pair of abrasive surfaced truncated conical disks as its sharpening structure. The disks are mounted on a rotatable shaft with the small ends of the disks in contact with each other.

5 Claims, 4 Drawing Sheets

(56) References Cited

U.S. PATENT DOCUMENTS

| | | | | |
|---|---|---|---|---|
| 5,611,726 | A | 3/1997 | Friel | |
| D409,891 | S | 5/1999 | Friel | |
| 6,012,971 | A | 1/2000 | Friel | |
| 6,071,181 | A | 6/2000 | Wightman et al. | |
| 6,113,476 | A | 9/2000 | Friel | |
| 6,267,652 | B1 | 7/2001 | Friel | |
| D491,783 | S | 6/2004 | Ikegaki et al. | |
| 6,752,702 | B1 | 6/2004 | Thompson et al. | |
| 6,802,763 | B1 | 10/2004 | Leung | |
| 6,863,600 | B2 | 3/2005 | Friel | |
| 6,875,093 | B2 | 4/2005 | Friel | |
| 6,876,093 | B2 | 4/2005 | Goto et al. | |
| 6,881,137 | B2 | 4/2005 | Friel | |
| 6,932,683 | B2 | 8/2005 | Li | |
| 6,997,795 | B2 | 2/2006 | Friel | |
| D542,616 | S | 5/2007 | Elek | |
| D543,430 | S | 5/2007 | Barr | |
| 7,235,004 | B2 * | 6/2007 | Friel, Sr. | B24D 15/065 451/198 |
| 7,287,445 | B2 | 10/2007 | Friel | |
| D567,611 | S | 4/2008 | Elek | |
| D575,124 | S | 8/2008 | Smith | |
| 7,452,262 | B2 | 11/2008 | Friel | |
| 7,488,241 | B2 | 2/2009 | Elek | |
| 7,494,403 | B2 | 2/2009 | Friel | |
| 7,517,275 | B2 | 4/2009 | Friel | |
| D605,918 | S | 12/2009 | Deglon | |
| 7,686,676 | B2 | 3/2010 | Friel | |
| D614,009 | S | 4/2010 | Deglon | |
| D620,332 | S | 7/2010 | Elek | |
| D632,153 | S | 2/2011 | Walker et al. | |
| 8,043,143 | B2 | 10/2011 | Elek | |
| D651,887 | S | 1/2012 | Elek | |
| D652,284 | S | 1/2012 | Elek | |
| D665,647 | S | 8/2012 | Friel | |
| 8,267,750 | B2 | 9/2012 | Friel | |
| D680,399 | S | 4/2013 | Elek et al. | |
| D688,545 | S | 8/2013 | Jensen et al. | |
| 8,585,462 | B2 | 11/2013 | Jensen et al. | |
| D699,534 | S | 2/2014 | Elek et al. | |
| 8,678,882 | B1 | 3/2014 | Huber et al. | |
| D705,625 | S | 5/2014 | Huber et al. | |
| 8,864,554 | B2 * | 10/2014 | Masalin | B24B 3/54 451/229 |
| 8,944,894 | B2 * | 2/2015 | Smith | B24D 15/081 451/196 |
| 9,168,627 | B2 | 10/2015 | Elek et al. | |
| 9,242,331 | B2 | 1/2016 | Elek et al. | |
| 2003/0077990 | A1 | 4/2003 | Li | |
| 2003/0236061 | A1 | 12/2003 | Li | |
| 2004/0077296 | A1 | 4/2004 | Friel et al. | |
| 2004/0198198 | A1 | 10/2004 | Friel et al. | |
| 2007/0077872 | A1 | 4/2007 | Elek et al. | |
| 2008/0261494 | A1 | 10/2008 | Friel et al. | |
| 2009/0209177 | A1 | 8/2009 | Walker | |
| 2009/0233530 | A1 | 9/2009 | Friel | |
| 2009/0298401 | A1 | 12/2009 | Smith et al. | |
| 2011/0034111 | A1 * | 2/2011 | Elek | B24B 3/54 451/45 |
| 2013/0165021 | A1 | 6/2013 | Jensen et al. | |
| 2014/0198198 | A1 | 7/2014 | Geissbuehler et al. | |

* cited by examiner

MANUAL SHARPENER

CROSS-REFERENCE TO RELATED APPLICATION

This application is based upon provisional application Ser. No. 61/104,133, filed Jan. 16, 2015, all of the details of which are incorporated herein by reference thereto.

BACKGROUND OF THE INVENTION

For many years a variety of manual (non-electric) sharpeners have been developed and sold using interdigitating, comb-like abrasive structures as described in U.S. Pat. Nos. 5,390,431 and 5,582,535.

Although this technology has been effective and broadly accepted by consumers, it had a number of limitations. First, the motion of the blade against the abrasive surfaces created a pattern of grooves along the edge facet that were parallel to the apex of the edge. These grooves tend to undercut and weaken the metal supporting the edge. Since the predominant mechanism of edge failure is the edge curling and folding over on itself, these grooves tend to reduce the durability of the edge.

Secondly, the finishing stage of these type of sharpeners, when using very fine grits of abrasives, develop an edge apex that is uninterrupted and perfectly linear. Although this type of edge is effective for many cutting functions, it was discovered that edges with micro serration are more effective for many household and outdoors applications. However, achieving a microserrated edge with interdigitating comb-like structures would be very difficult and costly.

SUMMARY OF THE INVENTION

An object of this invention is to provide an improved method and apparatus for sharpening of knives and other blades.

A further object of this invention is to provide an improved combination of sharpening technologies that cooperate with each other to provide a more effective and more durable edge.

It is a further object of this invention to provide unique multi-stage sharpeners, incorporating these improvements, that are able to sharpen blades of a variety of factory set edge angles.

In accordance with this invention the sharpener includes at least one pre-sharpening stage and a finishing stage. The abrasive sharpening structure in the pre-sharpening stage preferably is in the form of interdigitating comb-like abrasive structure. The abrasive structure in the finishing stage is a pair of abrasive surfaced truncated conical disks having their small ends disposed toward each other.

THE DRAWINGS

DETAILED DESCRIPTION

One embodiment of this invention is illustrated by FIGS. 1-4 which illustrate a two stage sharpener having alternative first pre-sharpening stages 1A and 1B and having a second finishing stage 2.

The first stages use interdigitating comb-like structures with coarse abrasives to quickly remove the necessary amount of metal from the dull and damaged edge, and form the first two facets of the edge. This is based on the technology of U.S. Pat. Nos. 5,390,431 and 5,582,535, all of the details of which are incorporated herein by reference thereto.

The second stage (finishing stage 2) is designed using the technology described in U.S. Pat. Nos. 8,043,143 and 9,168,627, all of the details of which are incorporated herein by reference thereto. This technology comprises a pair of diamond coated disks mounted on a rotatable shaft supported by molded-in bearings that are part of the molded sharpener structure. The sharpening disks are faced with an abrasive coated member that has the surface contour of a truncated cone. The disks are press fitted onto the rotatable shaft with the small ends of the truncated cones pressed into contact with each other on the shaft. Other variations using this principle will be obvious to those skilled in this art.

Figure 1:
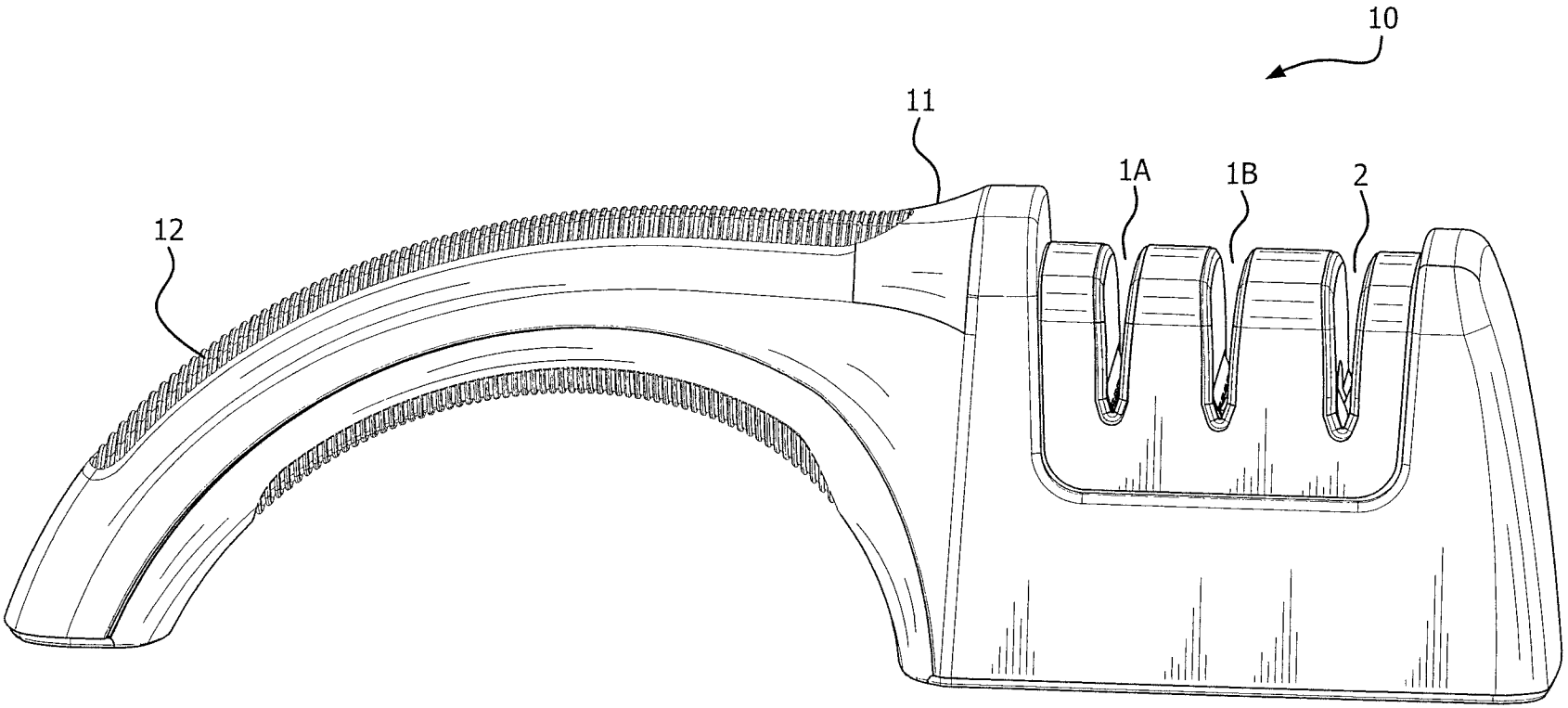
FIG. 1 is a side elevational view of a manual sharpener in accordance with this invention.

As shown in FIG. 1 sharpener 10 includes a housing 11 having a handle section 12 and a sharpening section. The sharpening section includes a first pre-sharpening stage 1A and an alternative first pre-sharpening stage 1B as well as a second finishing stage 2.

Figure 2:
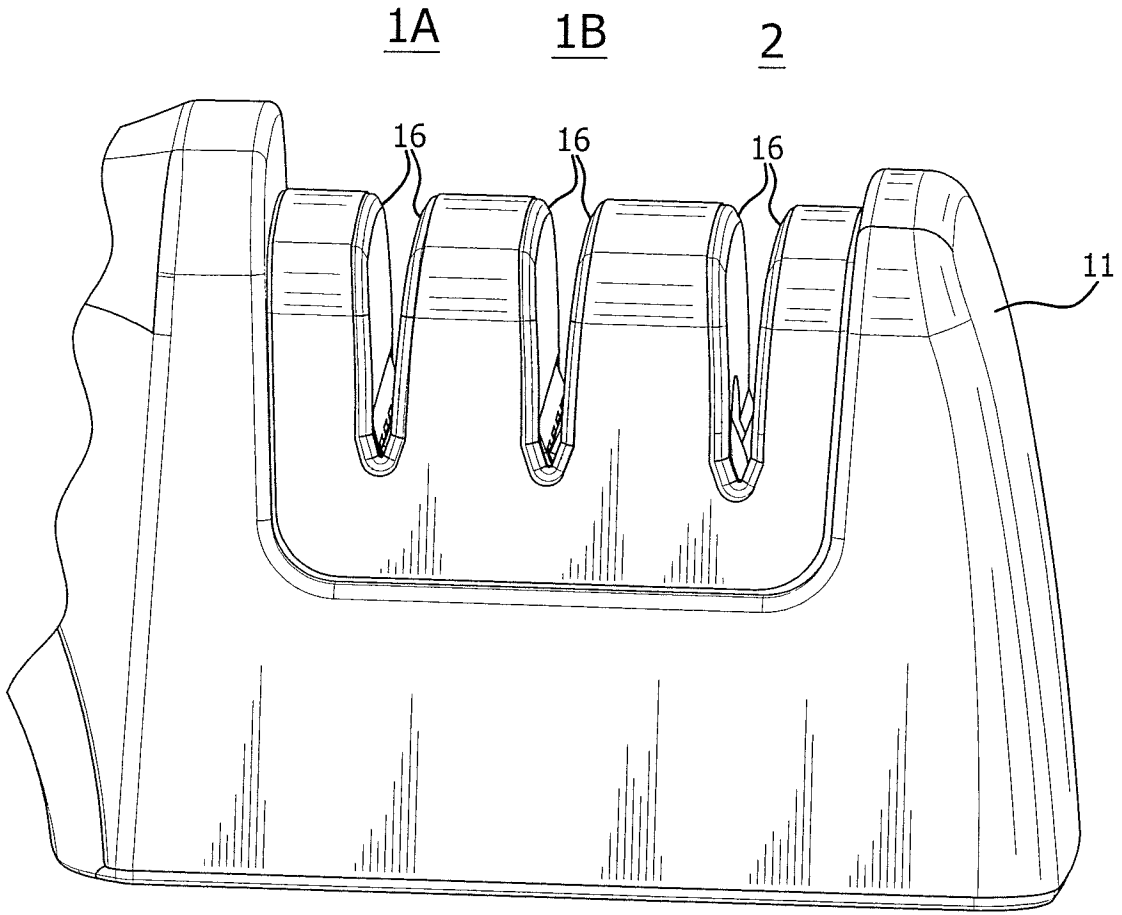
FIG. 2 is an enlarged view showing the alternate pre-sharpening stages (1A and 1B) and the finishing stage (2) of the sharpener of FIG. 1.

FIG. 2 illustrates the sharpening stages to include visual knife guide surfaces 16 in each stage to indicate where the knife should be inserted in each stage.

Figure 3:
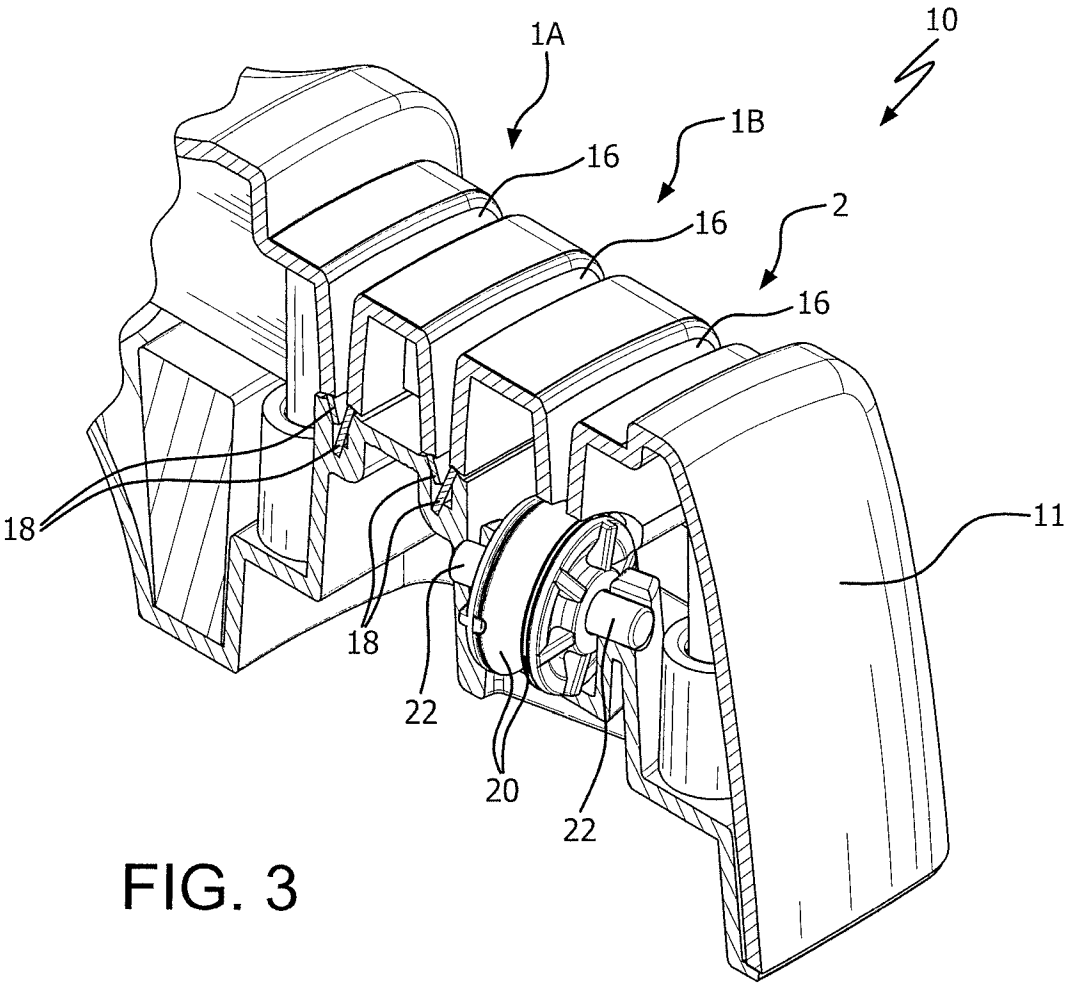
FIG. 3 is a sectional view of the portion of the sharpener shown in FIG. 2.
Figure 4:
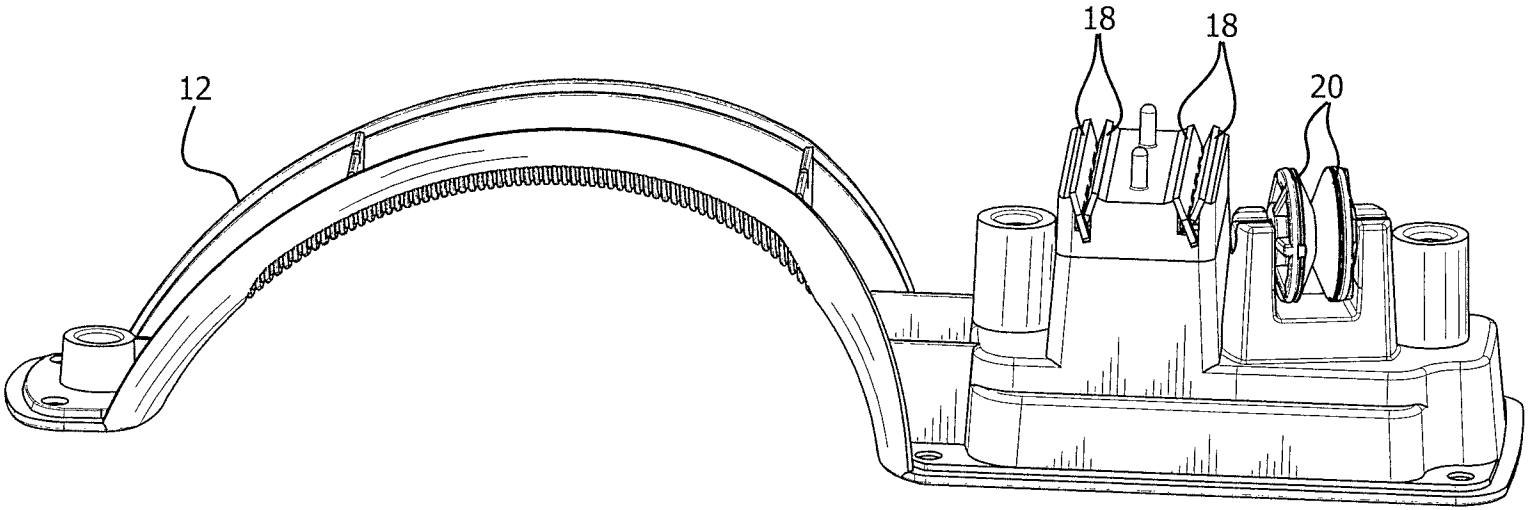
FIG. 4 is a perspective view of the sharpener shown in FIGS. 1-3 with the top portion of the housing removed.

As shown in FIGS. 3-4 first stage 1A and alternative first stage 1B use interdigitating comb-like structures 18 with coarse abrasives. Finishing stage or second stage 2 has as its sharpening structure a pair of abrasive coated disks 20 mounted on a rotatable shaft supported by molded-in bearings that are part of the molded sharpening structure. The sharpening disks 20 are faced with an abrasive coated member that has the surface contour of a truncated cone. The disks 20 are press fitted onto the shaft 22 with the small ends pressed into contact with each other. Preferably the disks are mirror images of each other coaxially mounted in suitable bearings on a freely movable rotatable shaft.

Although the interdigitating comb-like abrasive structure has some limitations, it provides some significant advantages. First, by using coarser abrasives, they can remove metal quickly and efficiently. Second, unlike rotating disk pair structures, their geometry allows the edge to be sharpened within 1/16" to 3/32" of the knife bolster or handle. Third, their geometry allows the two comb-like structures to be set at a broad range of total included angles to accommodate virtually any size edge angle in the range of 15°-90°, a versatility that a sharpening system totally based on paired rotating disk technology lacks. And, finally, they are very economical to produce since they can be manufactured in large planar matrixes to be separated into individual abrasive members prior to assembly into a sharpener.

Thus as described above and shown in FIG. 4, the comb-like structure 18,18 comprises two abrasive surfaced planar members fixed at an angle to each other. The members have interdigitating teeth which intersect and create a V-shaped abrasive surfaced trough.

By designing the second stage with the paired disk technology, the blade sharpener can utilize the above advantages of interdigitating pad technology but overcome their limitations.

First, by setting the finishing angle in these disks at a slightly larger angle than in the first stage, and using finer abrasives, the pattern of parallel grooves to the edge, which tend to undercut the edge and reduce the edge durability are removed and replaced by a new pattern of crossing grooves that are more perpendicular to the edge, creating a second facet at a larger angle and improving the durability of the edge.

Furthermore, this pair of second facets converge at the apex of the edge to form an edge with micro serrations that is more effective by providing more "bite."

Because of the versatility provided by the sharpening stages using abrasive coated interdigitating comb-like structures in sharpening a wide variety of edge angles, this design concept can be easily expanded to sharpening a wide variety of knives and other blades. For example, the inventors can envision a three stage sharpener, with the sharpening elements of the initial two sharpening stages 1A and 1B formed to sharpen 15° and 20° factory edges respectively, and the finishing stage 2, utilizing the rotating disk technology and where the sharpening elements are set at a slightly larger angle than 20°, providing the finishing stage for either type of edge. Thus, sharpener 10 could be used where pre-sharpening stage 1A is used for Asian style knives which have an angle, for example, between 12-18° while pre-sharpening stage 1B could be used for Western style or Euro/American style knives typically having an angle between 17 and 23°. Stage 2 could have an angle of 19-25° and should be greater than the angles of the pre-sharpening stages.

Although the preferred practice of this invention uses interdigitating, comb-like abrasive structures for the pre-sharpening stage, other pre-sharpening techniques could be used in combination with the finishing stage. Such pre-sharpening techniques could also have advantages, such as speed and/or economy, and would differ from the truncated conical disks of the finishing stage which have their small ends disposed toward and preferably in contact with each other. Alternate pre-sharpening elements include crossed diamond covered (or covered with other abrasives such as silicon carbide) rods, crossed tungsten carbide rods or plates with sharp edges, crossed ceramic or stone rods, and crossed rods made of hardened steels that have sharp edges. Similarly, these pre-sharpening elements can also take the shape of partially overlapping disks that provide a slot through which the knife edge can be drawn. Where there are two pre-sharpening stages, the sharpening structure in the two stages may differ from each other.

What is claimed is:

1. In a non-electric manual knife sharpener having at least one pre-sharpening stage and a finishing stage, the improvement being in that the pre-sharpening stage has first abrasive sharpening structure, the finishing stage having second abrasive sharpening structure, the first abrasive sharpening structure comprising interdigitating comb-like structure, the interdigitating comb-like structure comprising two abrasive surfaced planar members fixed at an angle to each other and having interdigitating teeth which intersect and create a V-shaped abrasive surfaced trough, the first abrasive sharpening structure quickly removing material from the edge of a blade being sharpened and creating a first facet at a pre-sharpening angle, the second abrasive sharpening structure being a pair of abrasive surfaced truncated conical disks having their small ends disposed toward each other, the disks being non-slidably mounted on a freely movable rotatable shaft, the disks of the finishing stage creating a finishing angle facet larger than the first facet, and the disks having a finer abrasive surface than the abrasive surface planar members.

2. The sharpener of claim 1 wherein the disks are press fitted onto the shaft with the small ends pressed into contact with each other.

3. The sharpener of claim 1 wherein there are two pre-sharpening stages.

4. The sharpener of claim 3 wherein the sharpening structure for one of the pre-sharpening stages disposes a blade edge at an angle between 12-18°, and the sharpening structure for the other pre-sharpening stage disposes the blade edge at an angle of 17-23°, and the sharpening structure in the finishing stage disposes the blade edge at an angle larger than the angles of the pre-sharpening stages.

5. The sharpener of claim 1 wherein the shaft is perpendicular to the direction of motion of the blade edge being sharpened.

* * * * *